US007008049B2

(12) United States Patent
Katayama

(10) Patent No.: US 7,008,049 B2
(45) Date of Patent: Mar. 7, 2006

(54) INKJET HEAD

(75) Inventor: Naoki Katayama, Kariya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 37 days.

(21) Appl. No.: 11/041,254

(22) Filed: Jan. 25, 2005

(65) Prior Publication Data

US 2005/0162483 A1 Jul. 28, 2005

(30) Foreign Application Priority Data

Jan. 26, 2004 (JP) ..... 2004-016482

(51) Int. Cl.
*B41J 2/045* (2006.01)

(52) U.S. Cl. ..... 347/71

(58) Field of Classification Search ..... 347/71, 347/68–70, 72, 94, 54, 20
See application file for complete search history.

(56) References Cited

U.S. PATENT DOCUMENTS 6,074,048 A * 6/2000 Hotomi et al. ..... 347/71
6,554,409 B1 * 4/2003 Ishii ..... 347/71
6,830,325 B1 * 12/2004 Hirota et al. ..... 347/94
6,846,069 B1 * 1/2005 Ito et al. ..... 347/71
2002/0175976 A1 11/2002 Okuda

FOREIGN PATENT DOCUMENTS

EP 1 375 148 A1 1/2004
JP A 11-309877 11/1999

* cited by examiner

*Primary Examiner*—K. Feggins

(57) ABSTRACT

An inkjet head has a channel unit including a manifold extending in one predetermined direction and a plurality of individual ink channels extending from the manifold to nozzles through pressure chambers respectively. The channel unit has a plurality of manifold plates for forming the manifold, damper plates provided between two plates of the plurality of manifold plates and communication holes. The damper plates partition the manifold into two spaces and have a damper chamber for absorbing a fluctuation of ink pressure in the manifold. The two spaces partitioned by the damper plates communicate with each other through the communication holes.

13 Claims, 13 Drawing Sheets

INKJET HEAD

BACKGROUND OF THE INVENTION

1. Field of the Invention

The present invention relates to an inkjet head for use in inkjet recording apparatus for ejecting ink onto a recording medium to perform printing thereon.

2. Description of the Related Art

In an inkjet head, ink supplied from an ink tank is distributed from a common ink channel to a plurality of pressure chambers. A pulsed pressure wave is selectively applied to each pressure chamber to change the volume of the pressure chamber. Thus, ink is ejected from a nozzle communicating with the pressure chamber. In that event, there may occur a so-called fluid crosstalk in which vibration generated in the pressure chamber applied with the pulsed pressure wave propagates to another pressure chamber through ink in the common ink channel so as to induce a fluctuation of pressure in the pressure chamber. When a fluctuation of pressure is induced in another pressure chamber due to fluid crosstalk described above, ink ejection properties such as the ink ejection rate, the ink droplet amount, etc. are changed in the pressure chamber where the fluctuation of pressure is induced. Thus, the print quality deteriorates.

Therefore, in order to absorb vibration propagating from each pressure chamber to the common ink channel so as to suppress fluid crosstalk, for example, there has been proposed an inkjet head in which a damper portion made of a thin plate is provided in an upper surface portion or a lower surface portion of the common ink channel (for example, see JP-A-11-309877 (FIG. 4))

SUMMARY OF THE INVENTION

In recent years, there increase demands for improvement in print speed and print quality. With the increase of the demands, there is a growing tendency to increase the number of nozzles and arrange the nozzles in high density. In this case, a large number of holes, grooves, etc. are provided densely in a plate for forming a common ink channel or other channels for supplying ink from the common ink channel to pressure chambers and nozzles. Thus, the area of the common ink channel is reduced in view from the thickness direction of the plate. Accordingly, even when a damper portion is provided in an upper surface portion or a lower surface portion of the common ink channel as in the inkjet head disclosed in JP-A-11-309877, the area of the damper portion contributing to absorption of vibration is so small that vibration propagating from the pressure chambers to the common ink channel cannot be absorbed sufficiently. In addition, due to the pressure chambers also arranged densely, the distance between coupling portions of the common ink channel and channels extending to respective pressure chambers from the common ink chamber becomes so short that vibration in the pressure chamber applied with a pulsed pressure wave is apt to propagate to another pressure chamber.

It is an object of the present invention to provide an inkjet head which can surely absorb vibration propagating from each pressure chamber to a common ink channel.

According to one aspect of the invention, there is provided with an inkjet head which includes: a channel unit including a common ink channel extending in one predetermined direction and a plurality of individual ink channels extending from the common ink channel to nozzles through pressure chambers respectively; the channel unit including a plurality of common ink channel formation plates forming the common ink channel, a damper portion provided between two plates included in the plurality of common ink channel formation plates, the damper portion partitioning the common ink channel into two spaces and having a damper chamber and at least one communication channel for allowing the two spaces partitioned by the damper portion to communicate with each other.

In this inkjet head, ejection energy is applied to ink in the pressure chambers so as to generate pressure waves. Thus, ink flowing in the plurality of individual ink channels is ejected from the nozzles connected to the pressure chambers. Here, the common ink channel is formed by the plurality of common ink channel formation plates laminated to one another. The damper portion having a damper chamber is provided between two plates included in the plurality of common ink channel formation plates. The common ink channel is partitioned into two spaces by the damper portion. Further, the two spaces partitioned by the damper portion communicate with each other through the communication channels so that ink and pressure waves can come and go between the two spaces freely.

When ejection energy is applied to ink in a pressure chamber, vibration generated in the pressure chamber may propagate to the common ink channel. The vibration is absorbed in the both surfaces of the damper portion in the two spaces partitioned by the damper portion. That is, the area of the damper portion contributing to absorption of vibration increases so that the vibration propagating to the common ink channel can be absorbed surely. Thus, fluid crosstalk can be suppressed.

DESCRIPTION OF THE PREFERRED EMBODIMENTS

Figure 1:
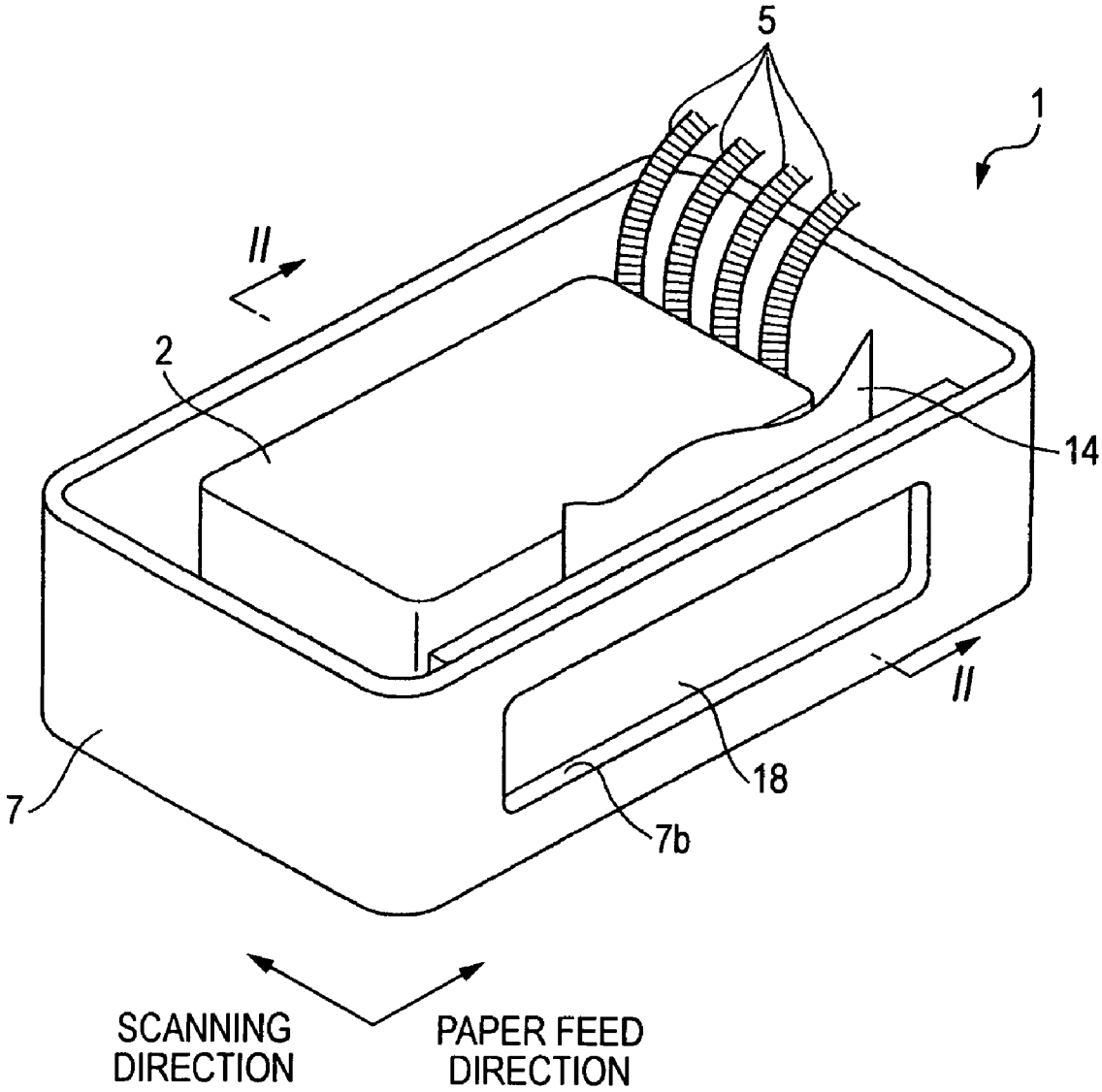
FIG. 1 is an overall perspective view of an inkjet head according to an embodiment of the invention.
Figure 2:
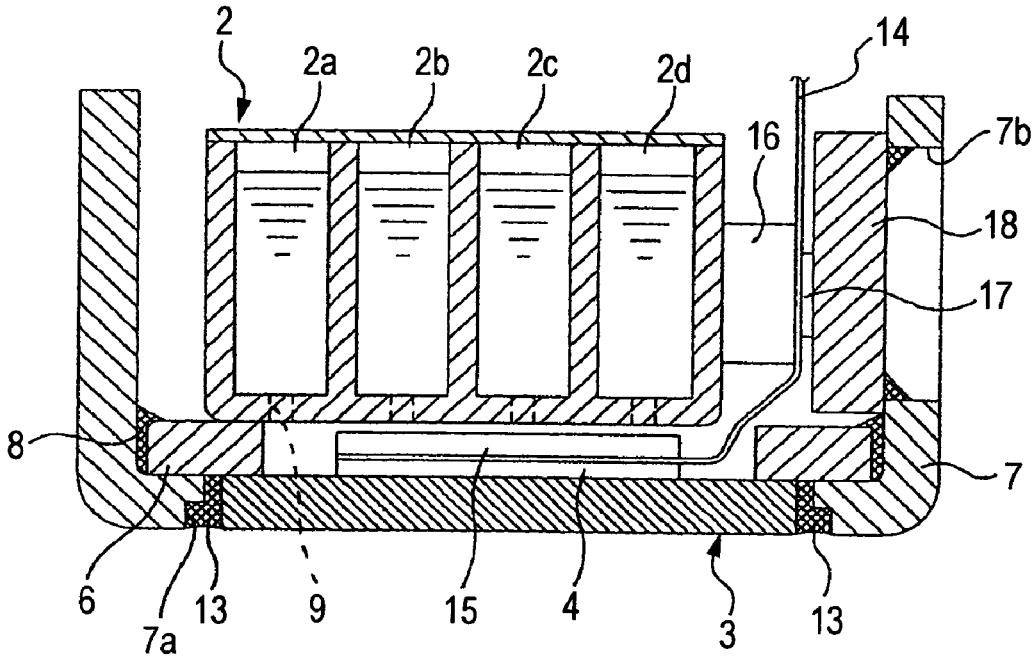
FIG. 2 is a sectional view taken on line II—II in FIG. 1.
Figure 3:
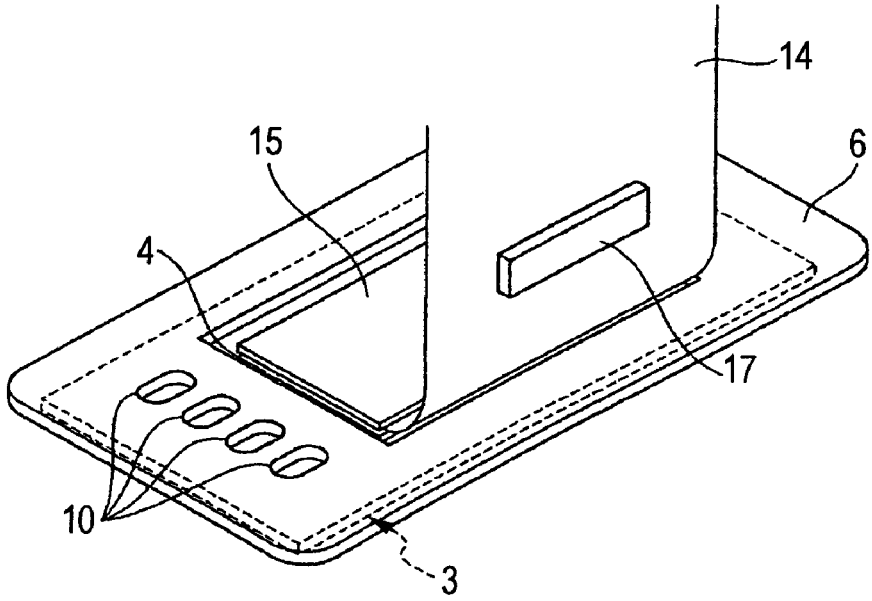
FIG. 3 is a perspective view of a main portion of the inkjet head.

An embodiment of the invention will be described. An inkjet head 1 according to this embodiment is provided in serial inkjet recording apparatus (not shown) and for ejecting four color inks of magenta, yellow, cyan and black onto conveyed paper so as to perform printing on the paper. As shown in FIGS. 1–3, the inkjet head 1 has an ink tank 2, a channel unit 3 and an actuator unit 4. In the ink tank 2, four ink chambers 2*a*, 2*b*, 2*c* and 2*d* reserving the four color inks respectively are formed. The channel unit 3 is disposed under the ink tank 2, and ink channels are formed in the channel unit 3. The actuator unit 4 is bonded to the upper surface of the channel unit 3.

Inside the ink tank 2, the four ink chambers 2*a*, 2*b*, 2*c* and 2*d* of magenta, yellow, cyan and black are formed to be aligned in the scanning direction in that order from the left of FIG. 2. Further, the four ink chambers 2*a*–2*d* are connected to corresponding ink cartridges (not shown) through tubes 5 respectively so that the color inks are supplied from the ink cartridges to the ink chambers 2*a*–2*d* respectively. In addition, as shown in FIGS. 2 and 3, the ink tank 2 is attached to a reinforcing plate 6 having a rectangular shape in plan view. The reinforcing plate 6 is fixedly provided in a substantially rectangular parallelepiped holder 7 by use of a curing agent 8. In a lower end portion of the ink tank 2, four openings 9 are formed to communicate with the four ink chambers 2*a*–2*d* respectively. On the other hand, in the reinforcing plate 6, four holes 10 each having an elliptic shape in plan view are formed to communicate with the four openings 9 respectively.

Figure 4:
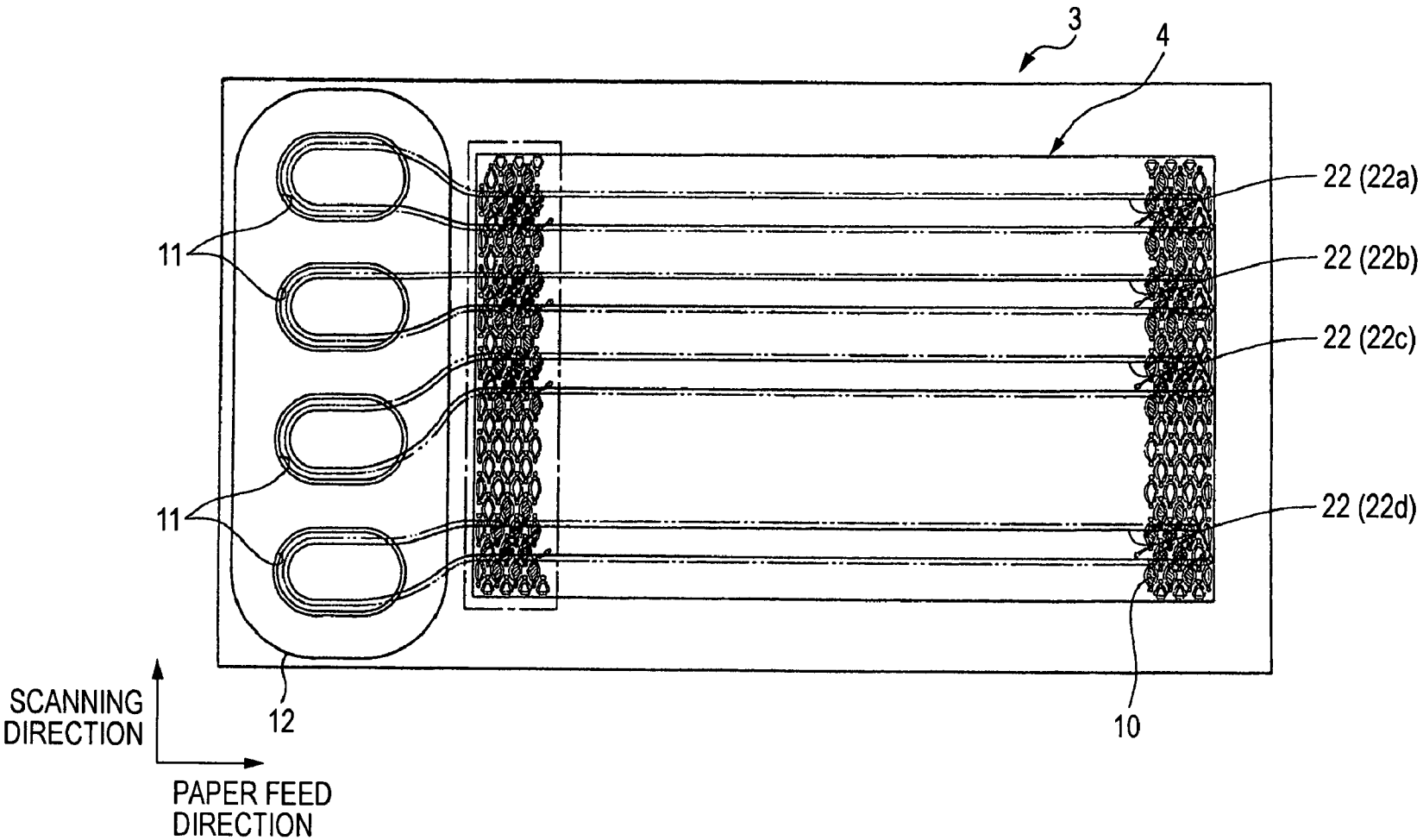
FIG. 4 is a plan view of a channel unit and an actuator unit.

Each of the channel unit 3 and the actuator unit 4 is designed to have a laminated structure in which a plurality of thin plates are bonded with each other. The channel unit 3 and the actuator unit 4 are disposed under the ink tank 2. As shown in FIG. 4, four ink supply holes 11 each having an elliptic shape in plan view are formed in the upper surface of the channel unit 3, and a filter 12 is further attached to the upper surface of the channel unit 3 so as to cover the four ink supply holes 11. The four kinds of inks in the ink chambers 2*a*–2*d* are supplied into the channel unit 3 through the four openings 9 formed in the ink tank 2, the four holes 10 formed in the reinforcing plate 6, and the four ink supply holes 11. As shown in FIGS. 2 and 3, the channel unit 3 bonded to the lower surface of the reinforcing plate 6 is attached to an opening portion 7*a* formed in the lower surface of the holder 7 so as to expose an ink ejection surface thereof. In this state, the ink tank 2 is attached to the reinforcing plate 6. On the other hand, sealing between the holder 7 and the channel unit 3 is secured by a sealant 13. A flexible printed circuit (FPC) 14 serving as a power supply member is bonded to the upper surface of the actuator unit 4, and extracted upward. In addition, a protective plate 15 made of an aluminum plate is bonded onto the FPC 14. As shown in FIG. 2, the actuator unit 4 or the protective plate 15 is thinner than the reinforcing plate 6. Accordingly, there occurs a clearance between the bottom surface of the ink tank 2 and the protective plate 15 when the inkjet head 1 has been assembled.

The FPC 14 bonded to the actuator unit 4 is extracted along a side surface of the ink tank 2 sandwiching an elastic member 16 such as sponge with the side surface. A driver IC 17 is placed on the FPC 14. The FPC 14 is electrically connected to the driver IC 17 and the actuator unit 4 by soldering so that a driving signal output from the driver IC 17 is transmitted to the actuator unit 4.

An opening portion 7*b* is formed in a position opposed to the driver IC 17 in a side surface of the holder 7. Through the opening portion 7*b*, heat generated in the driver IC 17 is radiated to the outside of the holder 7. Further, between the driver IC 17 and the opening portion 7*b* of the holder 7, a heat sink 18 made from a substantially rectangular parallelepiped aluminum plate is disposed in close contact with the driver IC 17. The heat generated in the driver IC 17 can be radiated efficiently due to the heat sink 18 and the opening portion 7*b*. The adhesion of the driver IC 17 to the heat sink 18 is secured by the pressing force of the elastic member 16 put between the ink tank 2 and the FPC 14.

Figure 5:
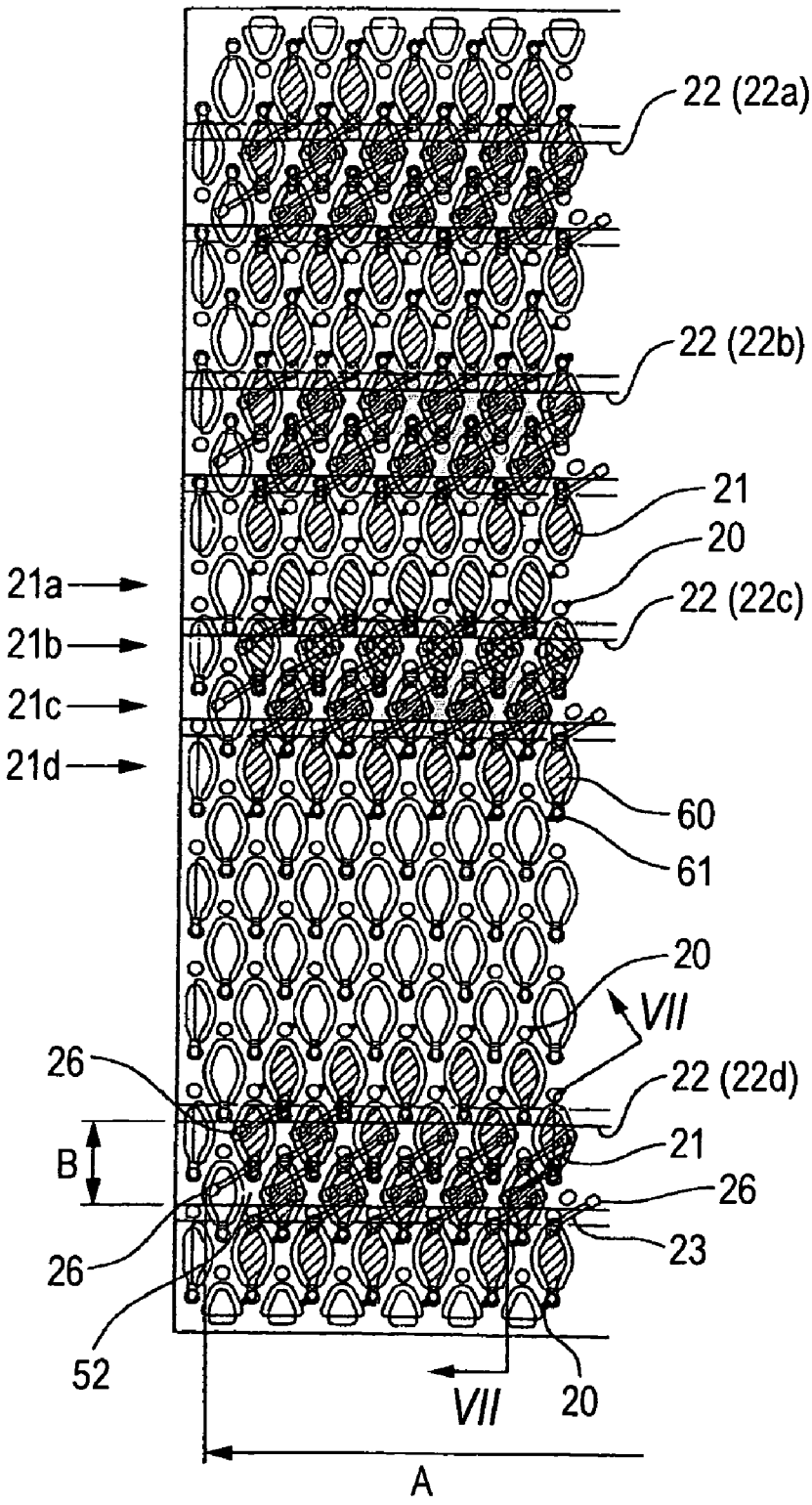
FIG. 5 is an enlarged view of a region surrounded by the one-dot chain line in FIG. 4.

Next, detailed description will be made about the channel unit 3 and the actuator unit 4 with reference to FIGS. 4–6, 7A–7B and 8. FIG. 4 is a plan view of the channel unit 3 and the actuator unit 4. FIG. 5 is an enlarged view of a region surrounded with the one-dot chain line depicted in FIG. 4. As shown in FIGS. 4 and 5, the channel unit 3 has a plurality of nozzles 20 for ejecting ink, a plurality of pressure chambers 21 connected at their one-side ends to the plurality of nozzles 20 respectively and arrayed two-dimensionally, and four manifolds 22 (22*a*, 22*b*, 22*c* and 22*d*) extending in a direction (paper feed direction: left/right direction in FIG. 4) perpendicular to the scanning direction (up/down direction in FIG. 4) on a horizontal plane and each communicating with a plurality of the pressure chambers 21. The lower surface of the channel unit 3 serves as an ink ejection region where a large number of nozzles 20 are arrayed. The actuator unit 4 having a rectangular shape in plan view is bonded to the upper surface of the channel unit 3 correspondingly to each pressure chamber 21.

Figure 7A:
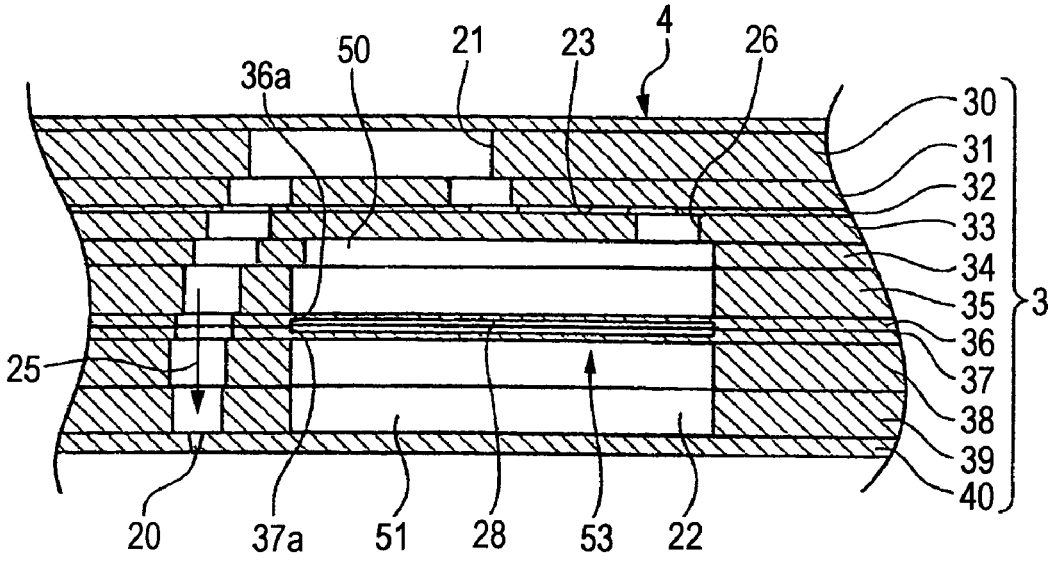
FIGS. 7A–7B are sectional views taken on line VII—VII in FIG. 5, FIG. 7A being a sectional view showing the case where the cutting plane does not pass through any communication hole provided in any damper chamber, FIG. 7B being a sectional view showing the case where the cutting plane passes through the communication hole.
Figure 7B:
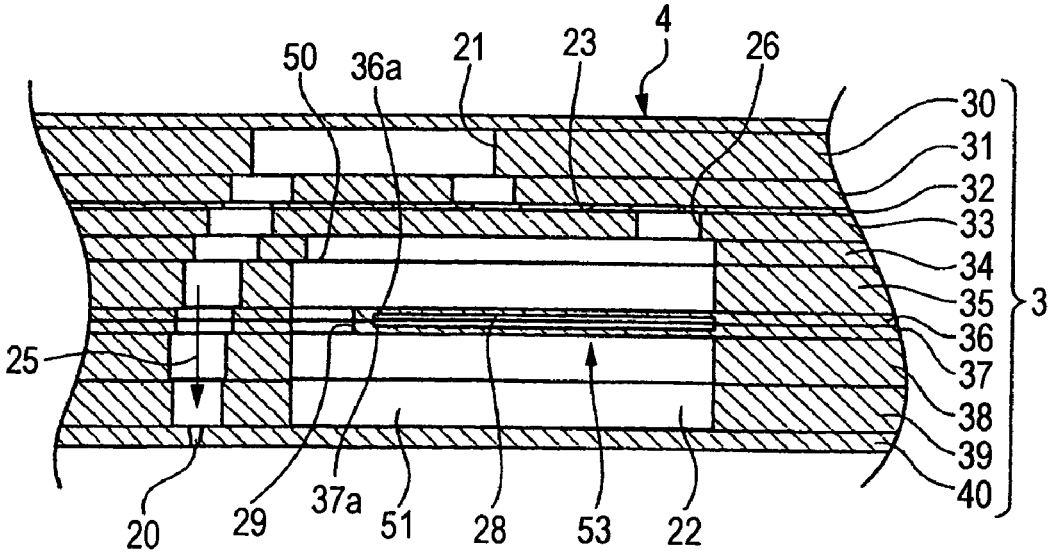

FIGS. 7A and 7B are sectional views taken on line VII—VII in FIG. 5. FIG. 7A is a sectional view showing the case where the cutting plane does not pass through any communication hole 29 (which will be described in detail later) provided in a damper chamber 28, and FIG. 7B is a sectional view showing the case where the cutting plane passes through the communication hole 29. As shown in FIG. 5 and FIGS. 7A–7B, each nozzle 20 is formed into a tapered shape so as to communicate with one of the manifolds 22 serving as a common ink channel, through a pressure chamber 21 and an aperture 23 each having a rhomboid shape in plan view. Thus, for each pressure chamber 21, an individual ink channel 25 is formed to extend from the manifold 22 to the nozzle 20 through the communication hole 26, the aperture 23 and the pressure chamber 21. On the other hand, a plurality of pressure chambers 21 are disposed in the upper surface of the channel unit 3 opposed to the bonded region of the actuator unit 4. As shown in FIG. 5, the plurality of pressure chambers 21 are arrayed in parallel to the manifolds 22 so as to form a plurality of pressure chamber arrays. A plurality of pressure chambers 21 constituting four adjacent pressure chamber arrays 21*a*–21*d* communicate with each manifold 22. The pressure chamber arrays 21*a*–21*d* have different positional relationships between each pressure chamber 21 and the manifold 22. Further, of the four pressure chamber arrays 21*a*–21*d* communicating with the manifold 22, the inside two, that is, the pressure chamber arrays 21*b* and 21*c* are disposed in regions opposed to the manifold 22 in plan view. On the other hand, the outside two, that is, the pressure chamber arrays 21*a* and 21*d* are disposed in regions on the opposite sides of the manifold 22. Each of FIGS. 7A–7B shows a sectional view cut by a cutting plane passing through pressure chambers 21 belonging to one of the pressure chamber arrays 21*b* and 21*c*.

Figure 6:
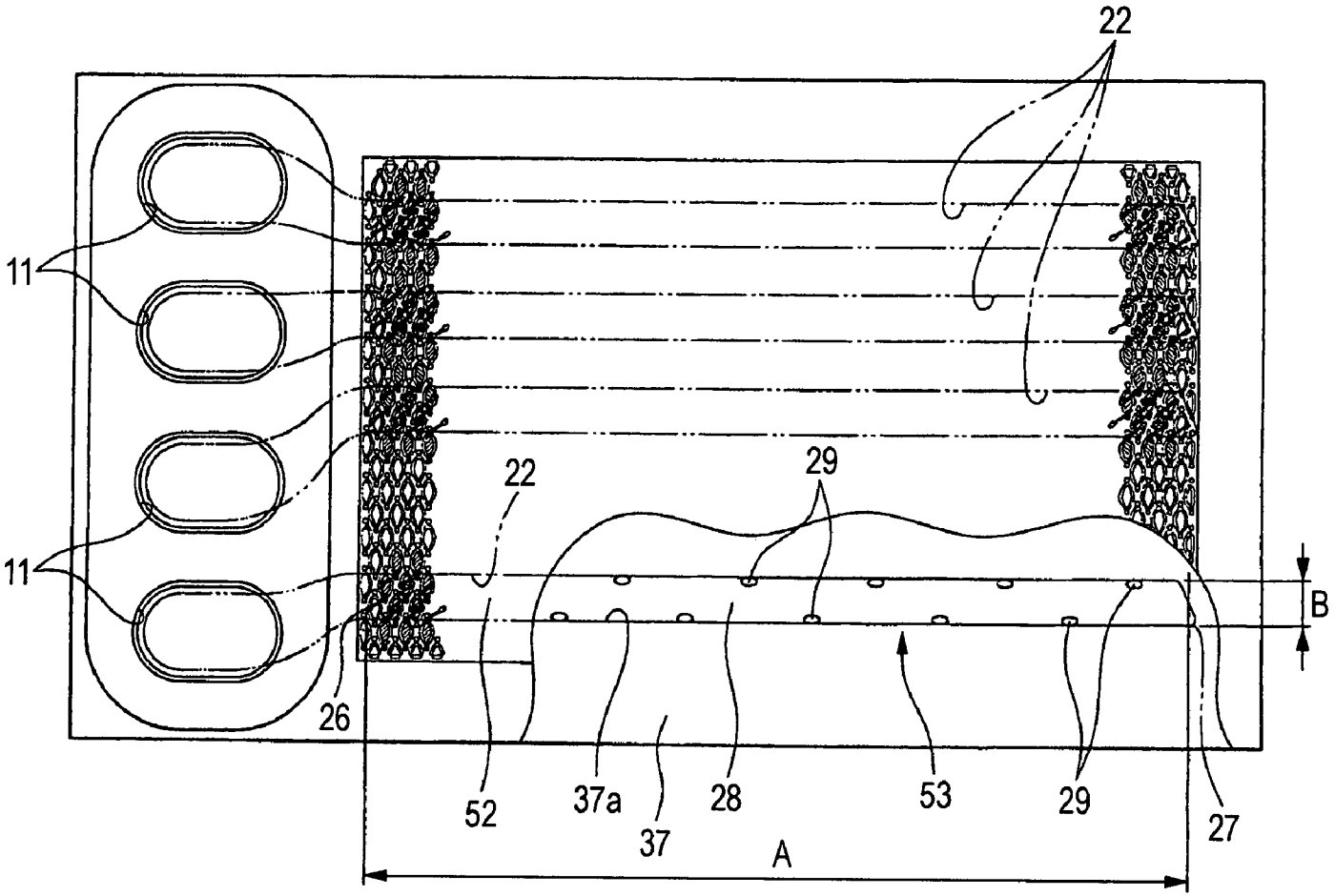
FIG. 6 is a partially cutaway plan view of the channel unit and the actuator unit.

As shown in FIGS. 4–6, the four manifolds 22*a*–22*d* extend from the four ink supply holes 11 to the tail ends of the pressure chamber arrays 21*a*–21*d* respectively. The downstream end portion of each manifold 22*a*–22*d* is closed by a closed end portion 27. In addition, the four manifolds 22*a*–22*d* are formed to have the same width and the same sectional shape. Of the four manifolds 22*a*–22*d,* the three located on the upper side of FIG. 4, that is, the manifolds 22*a*–22*c* are supplied with color inks of magenta, yellow and cyan from the ink chambers 2*a*–2*c* (see FIG. 2) respectively. On the other hand, the manifold 22*d* located on the lowest side of FIG. 4 is supplied with black ink from the ink chamber 2*d* (see FIG. 2).

When not-shown inkjet recording apparatus performs facsimile reception or copying, it is often the case that only the black ink is used. Accordingly, the black ink is more frequently used than any other color ink. Therefore, ink whose viscosity has been increased due to the air or drying is hardly retained in ink channels such as the manifold 22*d* where the black ink flows and the individual ink channels 25 corresponding to the manifold 22*d* in comparison with ink channels where the color inks flow with a low frequency of use. On the other hand, for each color ink having a low frequency of use, it is necessary to perform a purge operation for discharging the air or high-viscosity ink immediately before color printing. It is preferable that the purge operation is performed only on the ink channels where the color inks flow, so that the consumption of the black ink for the purge operation can be suppressed. To this end, the manifolds 22*a*–22*d* are arranged to partially provide a long interval (longer interval than between adjacent two of the three manifolds 22*a*–22*c* where the color inks flow) between the three manifolds 22*a*–22*c* to be supplied with the color inks and the manifold 22*d* to be supplied with the black ink. Thus, a purge cap can be attached to the nozzles 20 for ejecting the color inks while another purge cap can be attached to the nozzles 20 for ejecting the black ink.

As shown in FIGS. 7A and 7B, the channel unit 3 has a laminated structure in which a total of eleven plates of a cavity plate 30, a base plate 31, an aperture plate 32, a supply plate 33, manifold plates 34 and 35, damper plates 36 and 37, manifold plates 38 and 39, and a nozzle plate 40 are laminated. The actuator unit 4 is placed on the top of the cavity plate 30 which is the uppermost layer.

In the actuator unit 4, four piezoelectric sheets 41–44 (see FIGS. 9A–9B) are laminated, and electrodes are disposed, as will be described in detail later. Of the piezoelectric sheets 41–44, only the uppermost layer is set as a layer (hereinafter referred to as "layer having an active layer" simply) having a portion serving as an active layer when an electric field is applied thereto. The other three layers are set as inactive layers. Of the layers, the active layer is aligned with each pressure chamber 21 corresponding to the active layer. Thus, the actuator unit 4 is placed on the upper surface of the cavity plate 30.

The cavity plate 30 is a metal plate provided with a large number of rhomboid openings corresponding to the pressure chambers 21. The base plate 31 is a metal plate in which for each pressure chamber 21 of the cavity plate 30 a communication hole between the pressure chamber 21 and the aperture 23 and a communication hole between the pressure chamber 21 and the nozzle 20 are provided. The aperture plate 32 is a metal plate in which, for each pressure chamber 21 of the cavity plate 30, a communication hole between the pressure chamber 21 and the nozzle 20 is provided in addition to the aperture 23 formed by two holes and a half-etched region connecting the two holes with each other. The supply plate 33 is a metal plate in which, for each pressure chamber 21 of the cavity plate 30, a communication hole 26 (coupling portion) between the aperture 23 and the manifold 22 and a communication hole between the pressure chamber 21 and the nozzle 20 are provided. The manifold plates 34, 35, 38 and 39 are metal plates in which, for each pressure chamber 21 of the cavity plate 30, communication holes between the pressure chamber 21 and the nozzle 20 are provided in addition to holes which are connected with one another to thereby form the manifold 22 when the plates are laminated. The damper plates 36 and 37 are metal plates for forming damper chambers 28 for absorbing pressure vibration propagating from the pressure chambers 21 to the manifolds 22 respectively. In this embodiment, as shown in FIGS. 7A and 7B, the two damper plates 36 and 37 are disposed just in an intermediate position of each manifold 22 in the depth direction thereof. The nozzle plate 40 is a metal plate in which a nozzle 20 is provided for each pressure chamber 21 of the cavity plate 30.

Figure 8:
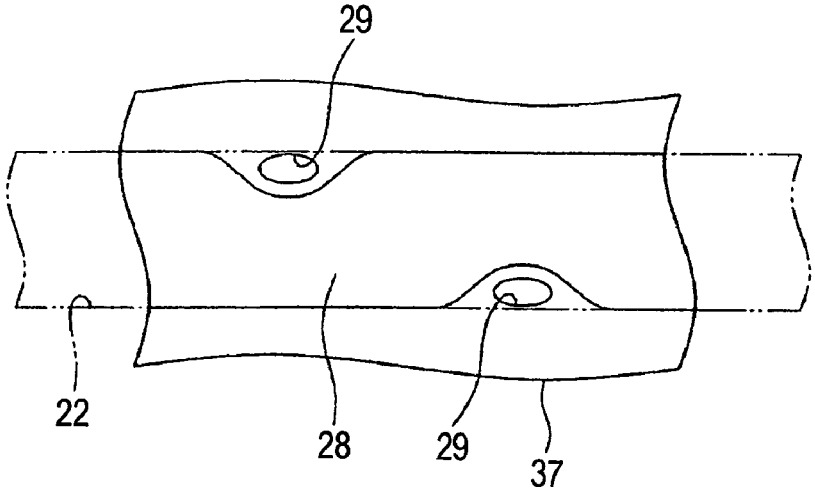
FIG. 8 is a main portion plan view of a damper plate.

Next, the two damper plates 36 and 37 will be described in detail with reference to FIGS. 6, 7A–7B and 8. Of those drawings, FIG. 8 is a plan view of a main portion of a damper plate disposed to form a damper chamber 28 in each manifold 22. The two damper plates 36 and 37 are put between the manifold plate 35 and the manifold plate 38 so as to form a damper portion 53 partitioning each manifold 22 into two, upper and lower spaces 50 and 51. In each of the damper plates 36 and 37, four groove-like recess portions 36*a,* 37*a* corresponding to the four manifolds 22 and having widths substantially equal to the widths of the manifolds 22 respectively are formed as half-etched regions. The two damper plates 36 and 37 are laid on each other so that the recess portions 36*a* and 37*a* are opposed to each other. Thus, damper chambers 28 are formed between the recess portions 36*a* and 37*a* respectively. The four damper chambers 28 are disposed in regions where the damper chambers 28 overlap the four manifolds 22 respectively in view from a direction perpendicular to the plane of FIG. 6. When ejection energy for ejecting ink from a nozzle 20 is applied to a corresponding pressure chamber 21 by the actuator unit 4, vibration propagates from the pressure chamber 21 to its corresponding manifold 22. The vibration is absorbed by the two damper plates 36 and 37 where the damper chambers 28 are formed internally. Thus, the vibration is prevented from propagating to any other pressure chamber 21.

Each damper chamber 28 overlaps a region 52 (coupling portion arrangement region: rectangular region defined by A and B in FIGS. 5 and 6 in this embodiment) in view from the laminated direction (perpendicular to the plane of FIG. 6) of the manifold plates 35 and 38. In the region 52, a plurality of communication holes 26 (coupling portions) to a plurality of individual ink channels 25 connected to the manifold 22 are disposed. The length A is a distance between two communication holes 26 (coupling portions) located at both ends (left and right ends in FIG. 6) in a direction that the manifold 22 extends and the length B is the width of the manifold 22. Accordingly, due to the damper portion 53, vibration propagating from a pressure chamber 21 where an ink ejection operation has been performed to a corresponding manifold 22 can be absorbed soon in the early stage of the propagation near the communication holes 26 serving as coupling portions with the individual ink channels 25. Thus, the vibration can be surely prevented from propagating to any other pressure chamber. It is preferable that each damper chamber 28 is formed to reach a position which are slightly (for example, about half the width of the manifold 22) closer to the both ends of the manifold 22 with respect to an extending direction of the manifold 22 than the communication holes 26 located at the both ends (left and right opposite ends in FIG. 6). Thus, vibration can be absorbed more surely by the damper portion 53 even near the communication holes 26 located at the opposite ends of the coupling portion arrangement region.

As shown in FIGS. 6, 7B and 8, a plurality of communication openings 29 are formed in regions of the two damper plates 36 and 37 opposed to the manifolds 22. Thus, the two, upper and lower spaces 50 and 51 partitioned by the two damper plates 36 and 37 communicate with each other through the communication holes 29. Accordingly, ink and vibration can come and go between the two, upper and lower spaces 50 and 51 through the communication openings 29. Thus, ink pressures in the two, upper and lower spaces 50 and 51 are substantially equalized. When a pressure chamber 21 initiates an ink ejection operation due to the actuator unit 4, vibration generated in the pressure chamber 21 propagates to its corresponding manifold 22. In this event, the pressure vibration in the two spaces 50 and 51 is absorbed in both the upper and lower surfaces of the damper portion 53. That is, of the damper portion 53, the area of parts contributing to absorption of vibration increases (to be about twice as large as the area of the manifold in view from the laminated direction of the manifold plates 35 and 38). Thus, unnecessary vibration propagating to the manifold 22 is absorbed so surely that fluid crosstalk can be suppressed.

In the portions where the communication openings 29 are provided, the width of the damper chamber 28 is narrowed inevitably. However, as shown in FIGS. 6 and 8, the communication openings 29 are formed zigzag on the width-direction edge sides of each manifold 22. Further, each communication opening 29 is formed into a long opening which is longer in the longitudinal direction of the manifold 22 than in the width direction thereof. Accordingly, the width of the damper chamber 28 can be made as large as possible even in the portions where the communication openings 29 are formed. Thus, the area of parts of the damper portion 53 contributing to vibration absorption can be increased.

In addition, the communication openings 29 are disposed at equal intervals in the longitudinal direction of each manifold 22 in a region where the communication openings 29 overlap the region 52 where a plurality of communication holes 26 are formed, in view from the laminated direction (perpendicular to the plane of FIG. 6) of the manifold plates 35 and 38. Accordingly, through the communication openings 29, ink or vibration can come and go smoothly between the two spaces 50 and 51 partitioned by the damper plates 36 and 37 near the communication holes 26 serving as coupling portions between the manifold 22 and the individual ink channels 25. As a result, stable supply of ink from each manifold 22 to each pressure chamber 21 and effective absorption of unnecessary vibration in each damper chamber 28 can be performed uniformly at any place. In addition, as shown in FIG. 6, the communication openings 29 are also provided near the closed end portion 27 of each manifold. Thus, ink can be prevented from being retained in the closed end portion 27, and further bubbles mixed into the ink can be prevented from being retained.

Figure 14:
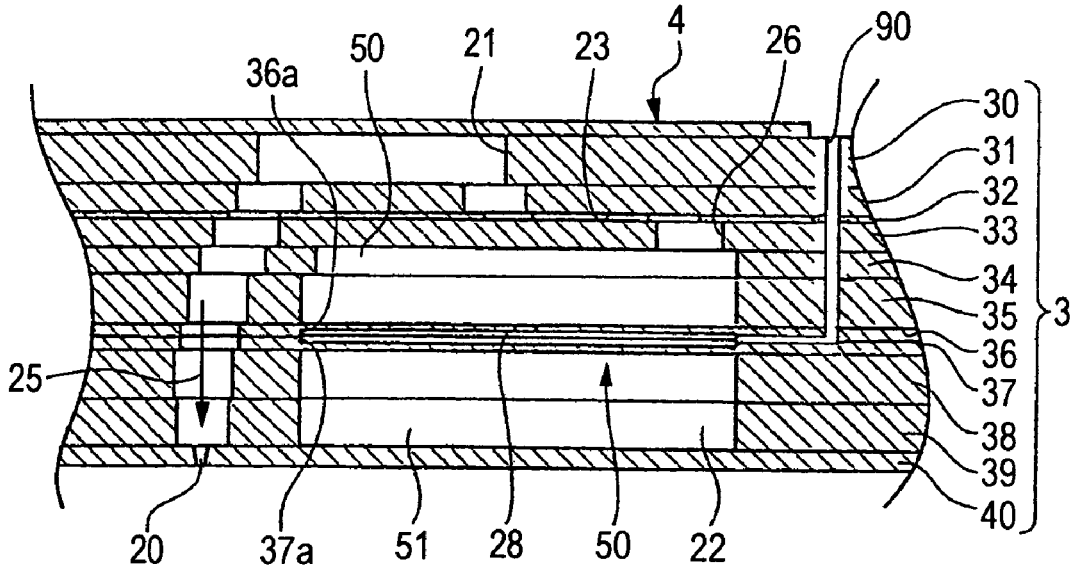
FIG. 14 is a view showing another modification corresponding to FIG. 7A.

In order to more enhance the vibration absorption effect of each damper chamber 28, the damper chamber 28 maybe allowed to communicate with the external atmosphere as shown in FIG. 14. An air communication hole 90 communicates an atmosphere with each damper chamber 28. In this case, it is preferable to build a structure in which ink or the like hardly enter into the damper chamber 28.

Figure 9A:
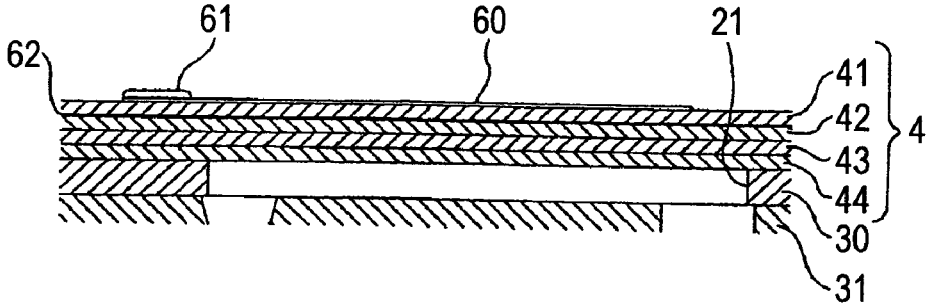
FIGS. 9A–9B are views showing the actuator unit, FIG. 9A being a sectional view, FIG. 9B being a plan view of an individual electrode.
Figure 9B:
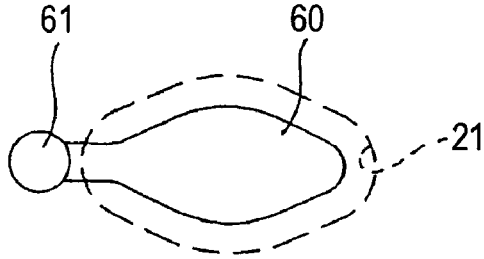

Next, description will be made about the configuration of the actuator unit 4 laminated to the cavity plate 30 which is the uppermost layer of the channel unit 3. FIG. 9A is a partially enlarged sectional view of the actuator unit 4 and a pressure chamber 21. FIG. 9B is a plan view of an individual electrode 60 bonded to the surface of the actuator unit 4.

As shown in FIG. 9A, the actuator unit 4 includes four piezoelectric sheets 41, 42, 43 and 44 formed to have one and the same thickness of about 15 μm. The piezoelectric sheets 41–44 are formed as continuous lamellar flat plates (continuous flat plate layers) to be disposed over a large number of pressure chambers 21 formed within one ink ejection region of the channel unit 3. When the piezoelectric sheets 41–44 are disposed as continuous flat plate layers over a plurality of pressure chambers 21, individual electrodes 60 can be disposed on the piezoelectric sheet 41 with high density, for example, by use of a screen printing technique. Accordingly, the pressure chambers 21 to be formed in positions corresponding to the individual electrodes 60 can be also disposed with high density. Thus, high-resolution images can be printed. The piezoelectric sheets 41–44 are made of a lead zirconate titanate (PZT) based ceramics material having ferroelectricity.

The individual electrodes 60 are formed on the piezoelectric sheet 41 which is the uppermost layer. A common electrode 62 about 2 μm thick is put between the piezoelectric sheet 41 which is the uppermost layer and the piezoelectric sheet 42 which is under the piezoelectric sheet 41, so that the common electrode 62 is formed all over the surfaces of the sheets. Incidentally, no electrode is disposed between the piezoelectric sheet 42 and the piezoelectric sheet 43. The individual electrodes 60 and the common electrode 62 are made of a metal material such as an Ag—Pd based metal material.

Each individual electrode 60 is about 1 μm thick. As shown in FIG. 9B, each individual electrode 60 has a rhomboid shape in plan view, which is substantially similar to the pressure chamber 21 shown in FIG. 5. One of acute angle portions in the rhomboid individual electrode 60 is extended and provided on its tip with a circular land portion 61 electrically connected to the individual electrode 60. The land portion 61 has a diameter of about 160 μm. The land portion 61 is, for example, made of gold containing glass frit. The land portion 61 is bonded onto the surface of an extended portion of the individual electrode 60 as shown in FIG. 9A. In addition, the land portion 61 is electrically connected to a contact point provided in the FPC 14.

The common electrode 62 is grounded in a not-shown region. Consequently, the common electrode 62 is kept in the ground potential equally over all the regions corresponding to all the pressure chambers 21. In addition, each individual electrode 60 is connected to the driver. IC 17 through the FPC 14 and the land portion 61. The FPC 14 includes individual lead wires which are independent of one another in accordance with the individual electrodes 60 (see FIGS. 1 to 3). Thus, the potential of each individual electrode 60 can be controlled correspondingly to each pressure chamber 21.

Next, description will be made about the operation of the actuator unit 4 when a pulsed pressure wave is applied to a pressure chamber 21. The piezoelectric sheet 41 in the actuator unit 4 has a polarizing direction in the thickness direction thereof. That is, the actuator unit 4 has a so-called unimorph type configuration in which one piezoelectric sheet 41 on the upper side (that is, on the opposite side to the pressure chambers 21) is set as a layer where an active layer exists, while three piezoelectric sheets 42–44 on the lower side (that is, on the pressure chambers 21 side) are set as inactive layers. Accordingly, when the individual electrodes 60 are set at positive or negative predetermined potential, each electric-field-applied portion interposed between electrodes in the piezoelectric sheet 41 will act as an active layer so as to contract in a direction perpendicular to the polarizing direction due to piezoelectric transversal effect, for example, if an electric field is applied in the same direction as the polarization. On the other hand, the piezoelectric sheets 42–44 are not affected by any electric field, and they do not contract voluntarily. Therefore, between the piezoelectric sheet 41 on the upper side and the piezoelectric sheets 42–44 on the lower side, there occurs a difference in strain in a direction perpendicular to the polarizing direction, so that the piezoelectric sheets 41–44 as a whole intend to be deformed to be convex on the inactive side (unimorph deformation). In this event, as shown in FIG. 9A, the lower surface of the piezoelectric sheets 41–44 is fixed to the upper surface of the cavity plate 30 which defines the pressure chambers 21. Consequently, the piezoelectric sheets 41–44 are deformed to be convex on the pressure chamber 21 side. Accordingly, the volume of each pressure chamber 21 is reduced so that the pressure of ink in the pressure chamber 21 increases. Thus, the ink is ejected from the nozzle 20 communicating with the pressure chamber 21. After that, when the individual electrodes 60 are restored to the same potential as the common electrode 62, the piezoelectric sheets 41–44 are restored to their initial shapes so that the volume of each pressure chamber 21 is restored to its initial volume. Thus, the pressure chamber 21 sucks ink from the manifold 22.

In the inkjet head 1 described above, the two damper plates 36 and 37 for forming the damper chambers 28 are put on each other so as to form the damper portions 53, by which each manifold 22 is partitioned into the two, upper and lower spaces 50 and 51. The two spaces 50 and 51 communicate with each other through the communication openings 29 so that ink and vibration can come and go freely between the two spaces 50 and 51. Accordingly, when pressure for ejecting ink from a nozzle 20 is applied to a corresponding pressure chamber 21 so that vibration generated in the pressure chamber 21 propagates to its corresponding manifold 22, pressure vibration in the two spaces 50 and 51 can be absorbed in both the upper and lower surfaces of the damper portion 53. That is, the area of the damper plates 36 and 37 contributing to absorption of vibration increases so that vibration propagating to each manifold 22 can be absorbed more surely. Thus, fluid crosstalk can be suppressed. Further, according to the invention, it is possible to provide the inkjet head 1 potentially having a wide range where the pressure chambers 21 can be arranged at high density without any influence of fluid crosstalk.

Next, description will be made about modifications in which various changes have been added to the aforementioned embodiment. Incidentally, parts having configurations similar to those in the aforementioned embodiment are denoted by the same reference numerals correspondingly, and description thereof will be omitted accordingly.

Figure 10:
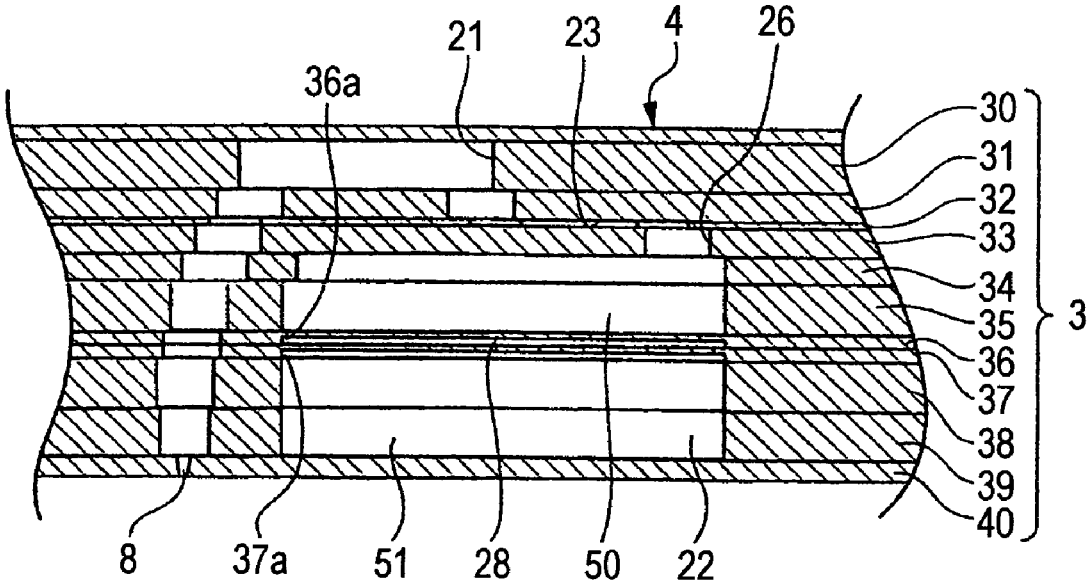
FIG. 10 is a view showing a modification corresponding to FIG. 7A.

1] Various structures may be used for the two damper plates if two thin portions (the bottom portions of the recess portions 36*a* and 37*a* in the aforementioned embodiment) facing the two spaces 50 and 51 are provided, and a damper chamber is provided between the two thin portions. For example, as shown in FIG. 10, two damper plates 36 and 37 in which recess portions 36*a* and 37*a* are formed respectively may be laid on each other so that the recess portions 36*a* and 37*a* face the same direction (downward in FIG. 10) while a damper chamber 28 is formed between the two damper plates 36 and 37. In this modification, the damper chamber 28 is formed by the recess portion 36*a* belonging to the upper damper plate 36. The damper effect depends not on the gap formed by the damper chamber 28 but on the thickness and area of each thin portion forming the damper chamber 28. In consideration of this fact, it is preferable that the upper and lower thin portions are disposed closely to each other but separately enough not to abut against each other due to deformation. In addition, in this modification, the recess portion 37*a* belonging to the lower damper plate 37 serves as a part of the space 51 under the manifold 22. Accordingly, the recess portion 37*a* contributes to improvement in the ink supply capacity of the manifold 22. In such a manner, this modification is designed to have a high space efficiency without losing an effective function of supplying ink stably by means of the manifold 22 and an effective function of absorbing unnecessary vibration by means of the damper chamber 28.

Alternatively, one of the damper plates may be formed as a thin-sheet-like damper plate having no recess portion, and laid on the other damper plate so as to cover recess portions formed in the other damper plate. Further, the structure may be made so that a synthetic resin film or the like is pasted onto a metal damper plate having recess portions. According to any one of these modifications, effect similar to that in the aforementioned modification can be attained.

2] The number of damper portions between the manifold plates is not limited to one. A plurality of damper portions may be provided between the manifold plates. In this case, the area of parts contributing to absorption of vibration increases in proportion to the number of damper portions. Thus, vibration can be absorbed more surely.

Figure 11:
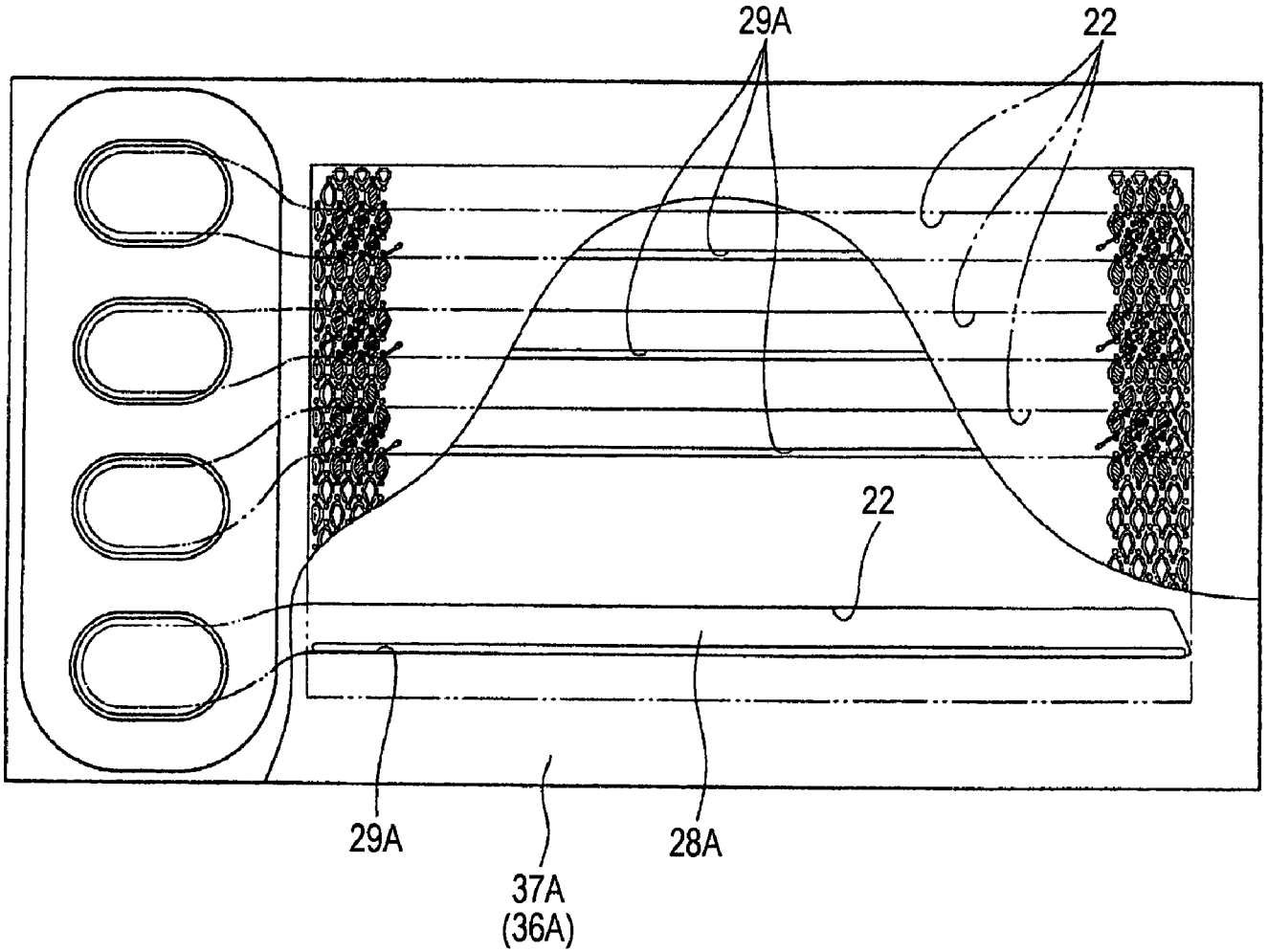
FIG. 11 is a view showing another modification corresponding to FIG. 6.

3] The number, shape and layout of communication openings are not limited to those in the aforementioned embodiment. For example, the communication openings maybe formed in a straight line only on one width-direction end side of each manifold 22. Alternatively, the communication openings may be disposed in the width-direction central positions of each manifold 22. Alternatively, as shown in FIG. 11, a communication opening 29A extending in the longitudinal direction of each manifold 22 may be formed in an one width-direction end side position of the manifold 22 in a damper plate 37A (36A). As a result, there is no fear that the distribution of the vibration absorption ability of each damper chamber 28A varies from place to place. Thus, the ink ejection properties are equalized.

Figure 12:
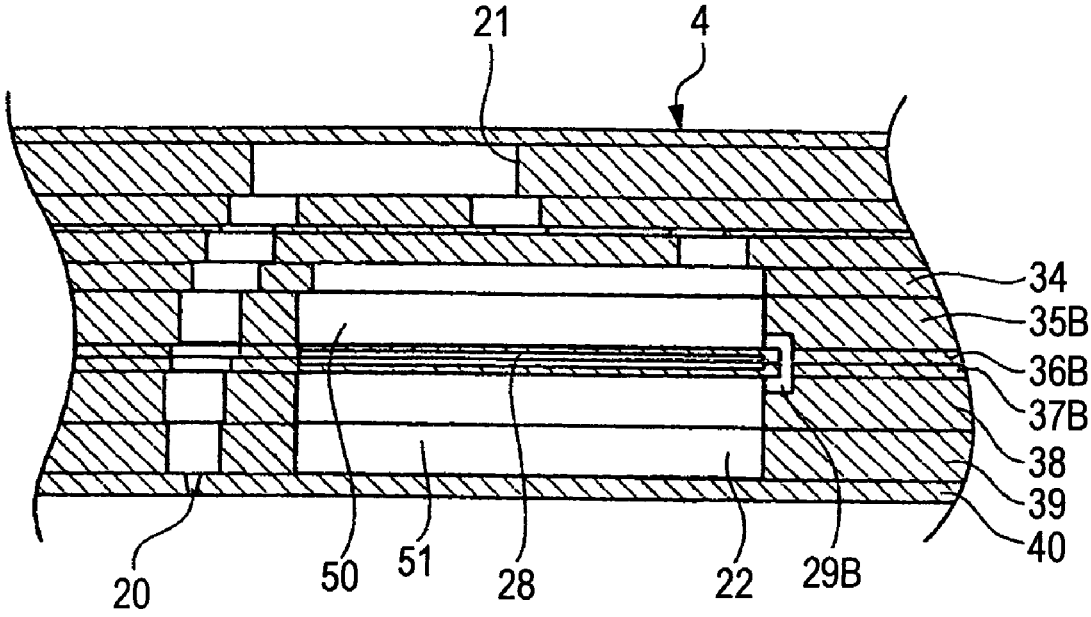
FIG. 12 is a view showing further another modification corresponding to FIG. 7A.
Figure 15:
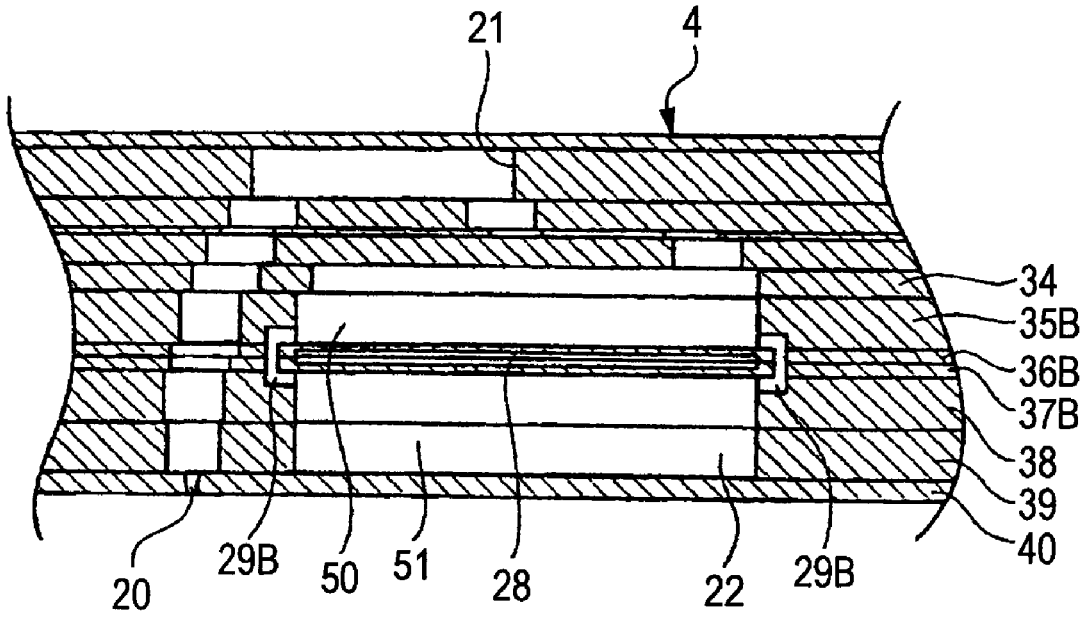
FIG. 15 is a view showing still further modification corresponding to FIG. 7A.

4] The communication openings may be disposed in regions which do not overlap the region 52 in damper plates 36B and 37B in view from the laminated direction of the manifold plates. In the region 52, the communication holes 26 are disposed. For example, as shown in FIG. 12, communication opening 29B may be provided on one width-direction end side of each manifold 22 in regions which do not overlap the region 52 where the communication holes 26 are disposed. In this case, ink flows through each manifold 22 so smoothly that the ink can be prevented from being retained. In addition, there is another advantage that the area occupied by the damper chamber 28 can be more expanded. Alternatively, the communication opening 29B may be disposed to reach the tail end of each manifold 22 and only in regions which do not overlap the region 52 where the communication holes 26 are disposed. Thus, bubbles can be also prevented from being retained. Alternatively, the communication openings 29B may be provided on both width-direction end sides of each manifold as shown in FIG. 15.

Thus, the communication openings for allowing the two spaces 50 and 51 to communicate with each other do not have to be provided in regions where the communication openings penetrate each damper portion and face each manifold 22. As shown in FIG. 12, communication opening 29B for allowing the two spaces 50 and 51 to communicate with each other may be formed in each of outside portions of manifold plates 35B and 38B and damper plates 36B and 37B in the width direction of each manifold 22.

Figure 13:
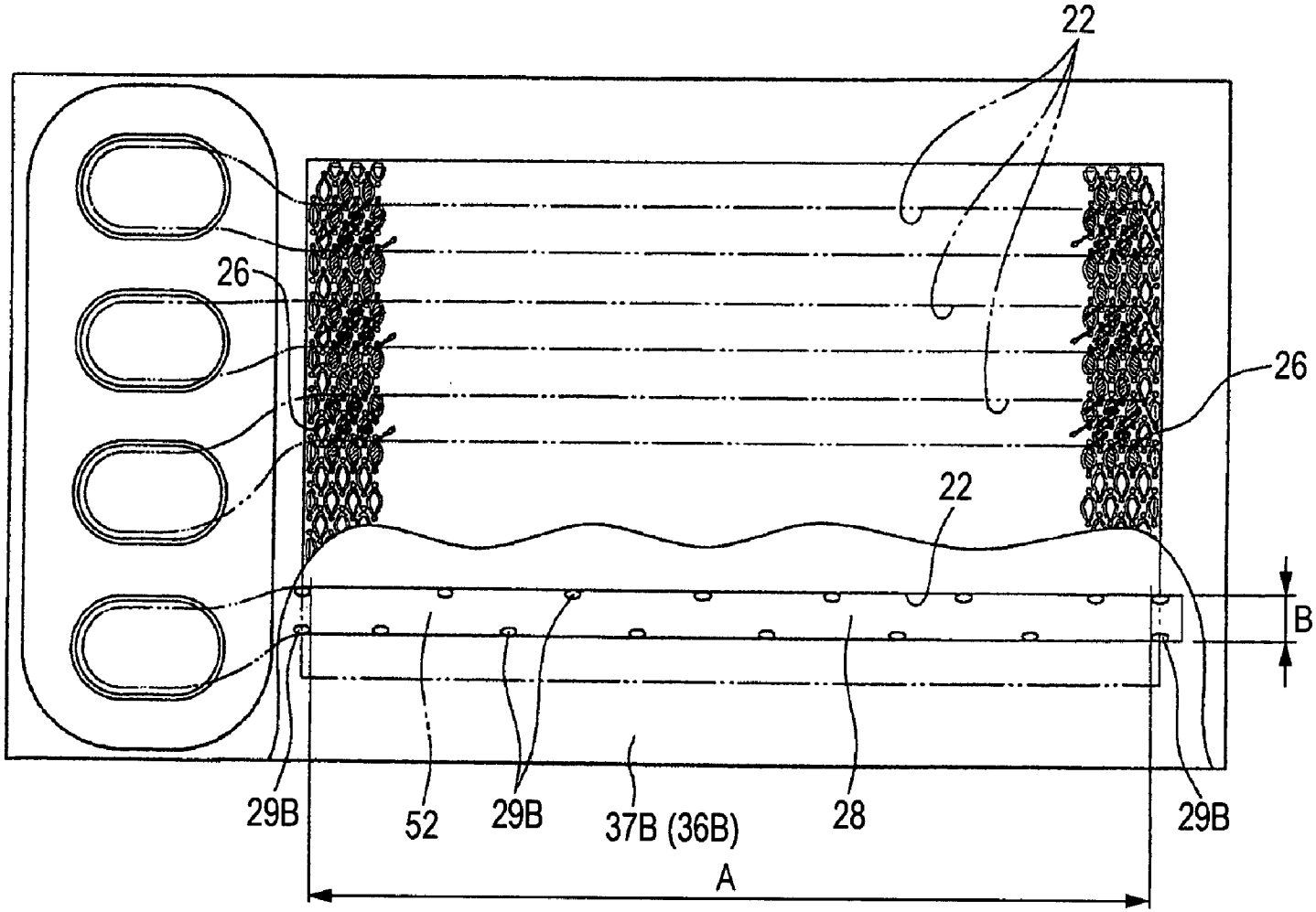
FIG. 13 is a view showing further another modification corresponding to FIG. 6.

FIG. 13 shows another modification where communication openings 29B are provided out of the coupling portion arrangement region. This modification is different from the aforementioned modifications in that the communication openings 29B are formed out of the coupling portion arrangement region defined by A in FIG. 13. Accordingly, ink can be supplied to each pressure chamber 21 more smoothly. Particularly, in a tail end portion of each manifold 22, the communication opening 29B are preferably formed to abut against the side walls of the manifold 22 on its one end side and its tail end side. As a result, there is no fear that ink is retained.

According to one or some of the embodiments, the damper portion includes two damper plates laminated to each other; a recess portion is formed in at least one of the two damper plates so as to have a width substantially equal to a width of the common ink channel and face the other of the two damper plates; and the damper chamber is formed between the recess portion and the other damper plate.

Accordingly, the damper portion can be formed only by a simple structure in which one damper plate having a recess portion formed therein is simply laid on the other damper plate. In addition, since the recess portion has almost the same width as the common ink channel, the width of the damper chamber formed by the two damper plates is substantially equal to the width of the common ink channel. Thus, the vibration absorption effect of the damper portion is enhanced.

According to one or some of the embodiments, the at least one communication channel includes communication openings formed in, of the two damper plates, regions opposed to the common ink channel. Accordingly, ink and pressure waves can come and go smoothly between the two spaces of the common ink channel partitioned by the two damper plates. Thus, the pressures of ink in the two spaces are substantially equalized so that vibration propagating to the common ink channel can be surely absorbed by both the surfaces of the damper portion.

According to one or some of the embodiments, the communication openings are formed in, of the regions opposed to the common ink channel, regions at width-direction ends of the common ink channel. Accordingly, even in any portion where the communication holes are formed, the area of the damper portion contributing to absorption of vibration in the common ink channel can be made as large as possible.

According to one or some of the embodiments, each of the communication openings is formed into a shape longer in a longitudinal direction of the ink channel than in a width direction thereof. Accordingly, even in any portion where the communication openings are formed, the area of the damper chamber in the width direction of the common ink channel is expanded so that the area of the damper portion contributing to absorption of vibration in the common ink channel can be made as large as possible.

According to one or some of the embodiments, the two damper plates are made of the same member. When one and the same member is used as the two damper plates in such a manner, the manufacturing cost can be reduced.

According to one or some of the embodiments, the damper chamber of the damper portion overlaps a coupling portion arrangement region in view from a laminated direction of the common ink channel formation plates, the coupling portion arrangement region being a region where coupling portions between the common ink channel and the individual ink channels are disposed. Since the damper chamber is disposed thus in a region where the common ink channel overlaps the coupling portion arrangement region, vibration propagating from each pressure chamber to the common ink channel can be absorbed soon in an early stage of the propagation near the coupling portion with the individual ink channel to the pressure chamber. Thus, the vibration can be surely prevented from propagating to other pressure chambers.

According to one or some of the embodiments, the at least one communication channel includes a plurality of communication channels disposed at equal intervals in a longitudinal direction of the common ink channel in regions where the communication channels overlap the coupling portion arrangement region in view from a laminated direction of the common ink channel formation plates. Accordingly, near the coupling portions between the common ink channel and the individual ink channels, ink or pressure waves can come and go uniformly at any place between the two spaces partitioned by the damper portion. Thus, ink can be supplied from the common ink channel to the pressure chambers stably.

According to one or some of the embodiments, the at least one communication channel is disposed in regions at at least one width-direction end side of the common ink channel where the at least one communication channel does not overlap the coupling portion arrangement region in view from the laminated direction of the common ink channel formation plates. Accordingly, ink flows smoothly in the common ink channel so that the ink can be prevented from being retained.

According to one or some of the embodiments, the common ink channel has a closed end portion closing a downstream end portion of the common ink channel, and the at least one communication channel is disposed near the closed end portion. Accordingly, ink can be prevented from being retained in the closed downstream end portion of the common ink channel. Further, bubbles mixed into the ink can be also prevented from being retained.

What is claimed is:

1. An inkjet head comprising:

a channel unit which includes a common ink channel which extends in one predetermined direction, and a plurality of individual ink channels extending from the common ink channel to nozzles through pressure chambers respectively, wherein the channel unit includes: a plurality of common ink channel formation plates forming the common ink channel; and a damper portion provided between two plates included in the plurality of common ink channel formation plates, the damper portion includes a damper chamber, and partitions the common ink channel into two spaces, the channel unit includes at least one communication channel which allows the two spaces partitioned by the damper portion to communicate with each other.

2. An inkjet head according to claim 1, wherein the damper portion includes two damper plates laminated to each other, a recess portion is formed in at least one of the two damper plates to have a width substantially equal to a width of the common ink channel and face the other of the two damper plates, and the damper chamber is formed between the recess portion and the other damper plate.

3. An inkjet head according to claim 2, wherein the at least one communication channel includes communication openings formed in, of the two damper plates, regions opposed to the common ink channel.

4. An inkjet head according to claim 3, wherein the communication openings are formed in, of the regions opposed to the common ink channel, regions at width-direction ends of the common ink channel.

5. An inkjet head according to claim 3, wherein each of the communication openings is formed into a shape longer in a longitudinal direction of the ink channel than in a width direction of the ink channel.

6. An inkjet head according to claim 2, wherein the two damper plates are made of the same member.

7. An inkjet head according to claim 1, wherein the damper chamber of the damper portion overlaps a coupling portion arrangement region in view from a laminated direction of the common ink channel formation plates, the coupling portion arrangement region being a region where coupling portions between the common ink channel and the individual ink channels are disposed.

8. An inkjet head according to claim 7, wherein the at least one communication channel includes a plurality of communication channels disposed at equal intervals in a longitudinal direction of the common ink channel in regions where the communication channels overlap the coupling portion arrangement region in view from a laminated direction of the common ink channel formation plates.

9. An inkjet head according to claim 7, wherein the at least one communication channel is disposed in regions at at least one width-direction end side of the common ink channel where the at least one communication channel does not overlap the coupling portion arrangement region in view from the laminated direction of the common ink channel formation plates.

10. An inkjet head according to claim 9, wherein the at least one communication channel includes a plurality of communication channels disposed in regions at both width-direction end sides of the common ink channel where the plurality of communication channels do not overlap the coupling portion arrangement region in view form the laminated direction of the common ink channel formation plates.

11. An inkjet head according to claim 1, wherein the common ink channel has a closed end portion closing a downstream end portion of the common ink channel, and the at least one channel is disposed near the closed end portion.

12. An inkjet head according to claim 1, wherein the damper chamber communicates with an atmosphere via an air communicating hole.

13. An inkjet head according to claim 1, wherein the damper chamber overlaps, in view from a laminated direction of the common ink channel formation plates, coupling portions between the common ink channel and the individual ink channels.

* * * * *